US009534489B2

(12) United States Patent
Wang et al.

(10) Patent No.: US 9,534,489 B2
(45) Date of Patent: Jan. 3, 2017

(54) MODELING ACID DISTRIBUTION FOR ACID STIMULATION OF A FORMATION

(71) Applicants: XiaoWei Wang, Houston, TX (US); Terry R. Bussear, Spring, TX (US)

(72) Inventors: XiaoWei Wang, Houston, TX (US); Terry R. Bussear, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 395 days.

(21) Appl. No.: 14/169,241

(22) Filed: Jan. 31, 2014

(65) Prior Publication Data

US 2014/0251601 A1 Sep. 11, 2014

Related U.S. Application Data

(60) Provisional application No. 61/773,582, filed on Mar. 6, 2013.

(51) Int. Cl.
*E21B 47/06* (2012.01)
*E21B 43/28* (2006.01)
*E21B 47/12* (2012.01)

(52) U.S. Cl.
CPC ..... *E21B 47/065* (2013.01); *E21B 43/28* (2013.01); *E21B 47/123* (2013.01)

(58) Field of Classification Search
CPC ..... E21B 43/17; E21B 47/06; E21B 47/065
See application file for complete search history.

(56) References Cited

U.S. PATENT DOCUMENTS

2004/0020642 A1* 2/2004 Vinegar ..... B09C 1/02 166/245
2009/0308613 A1 12/2009 Smith
2011/0132609 A1 6/2011 Van Hal et al.
2011/0146982 A1* 6/2011 Kaminsky ..... E21B 43/247 166/272.2
2012/0012308 A1 1/2012 Ziauddin et al.

FOREIGN PATENT DOCUMENTS

JP 2009532677 A 9/2009
KR 1020080074905 A 8/2008

OTHER PUBLICATIONS

Tardy,P.M.J. et al, Inversion of DTS Logs to measure Zonal Coverage During and After Wellbore Treatments With Coiled tubing, SPE 14331, Apr. 2011.*

(Continued)

*Primary Examiner* — William P Neuder
(74) *Attorney, Agent, or Firm* — Cantor Colburn LLP

(57) ABSTRACT

A method of evaluating a stimulation operation includes: receiving parameter information for the stimulation operation, the stimulation operation including injecting an acid stimulation fluid into an earth formation along a selected length of a borehole from a tubular disposed in the borehole; and generating, by a processor, a thermal model based on one or more energy balance equations that account for at least a first heat source and a second heat source, the first heat source expected to produce heat during the stimulation by a chemical reaction between an acid in the stimulation fluid and the formation, and the second heat source including expected geothermal heat from the formation.

21 Claims, 7 Drawing Sheets

(56) References Cited

OTHER PUBLICATIONS

Wang, et al., "Real-time Evaluation of Acid Stimulation Performance in Extended-Reach Carbonate Wells with DTS-enabled Intelligent Completions",SPE Middle East Intelligent Energy Conference and Exhibition held in Dubai, UAE, Oct. 2013; 12 pages.
Notification of Transmittal of the International Search Report and the Written Opinion of the International Searching Authority, or the Declaration; PCT/US2014/017365; Mail date: Jun. 9, 2014; 15 pages.

* cited by examiner

MODELING ACID DISTRIBUTION FOR ACID STIMULATION OF A FORMATION

REFERENCE TO RELATED APPLICATION

The present application claims the benefit of and priority to U.S. Provisional Application No. 61/773,582, entitled "MODELING ACID DISTRIBUTION FOR ACID STIMULATION OF A FORMATION", filed on Mar. 6, 2013, under 35 U.S.C. §119(e), which is incorporated herein by reference in its entirety.

BACKGROUND

Various techniques may be employed to stimulate hydrocarbon production in subterranean formations. For example, acid stimulation may be performed, in which an acid is flowed downhole within a tubular disposed in a borehole, and released into the borehole to treat the formation and stimulate fluid flow into or from the formation. After release of the acid from the tubular, hydrocarbons are received by the tubular.

Temperature and fluid flow measurements of wellbores in earth formations may be utilized to monitor stimulation processes. Examples of temperature measurement systems include Distributed Temperature Sensing (DTS) technologies, which utilize fiber optic cables or other devices capable of measuring temperature values at multiple locations along the length of a wellbore. DTS can be used to measure, for example, a continuous temperature profile along the wellbore.

SUMMARY

Embodiments include a method of evaluating a stimulation operation. The method includes: receiving parameter information for the stimulation operation, the stimulation operation including injecting an acid stimulation fluid into an earth formation along a selected length of a borehole from a tubular disposed in the borehole; and generating, by a processor, a thermal model based on one or more energy balance equations that account for at least a first heat source and a second heat source, the first heat source expected to produce heat during the stimulation by a chemical reaction between an acid in the stimulation fluid and the formation, and the second heat source including expected geothermal heat from the formation.

Embodiments also include an earth formation stimulation system. The borehole stimulation system includes: a stimulation assembly configured to be disposed in a borehole and perform a stimulation operation, the stimulation assembly including a tubular and at least one injection device configured to inject an acid stimulation fluid into an earth formation; a sensor assembly configured to take a plurality of temperature measurements along a selected length of the borehole; and a processor in operable communication with the sensor assembly, the processor configured to receive the plurality of temperature measurements and apply a thermal model to the plurality of temperature measurements, the model based on one or more energy balance equations that account for at least a first heat source and a second heat source, the first heat source expected to produce heat during the stimulation operation by a chemical reaction between an acid in the stimulation fluid and the formation, and the second heat source including expected geothermal heat from the formation.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Apparatuses, systems and methods are provided for performing and/or facilitating stimulation of subterranean formations for, e.g., hydrocarbon production. An exemplary stimulation process is acid stimulation. An embodiment of a stimulation monitoring/evaluating apparatus includes a processor configured to receive borehole fluid measurement parameters (and other downhole measurements) and evaluate stimulation processes using a model that simulates acid distribution based on solving momentum and energy balance in the borehole and/or in production conduits. In one embodiment, the model is based on both steady-state flow and unsteady-state heat transfer. In one embodiment, the model takes into account heat exchange during acid stimulation by modeling geothermal heat and heat produced by chemical reactions between acid in a stimulation fluid and a formation, and may also account for heat exchange between downhole components and a borehole annulus. The model and accompanied methods provide a way to evaluate the effectiveness of acid stimulation, allowing operators to determine where and how much acid goes to the targeted formation.

Figure 1:
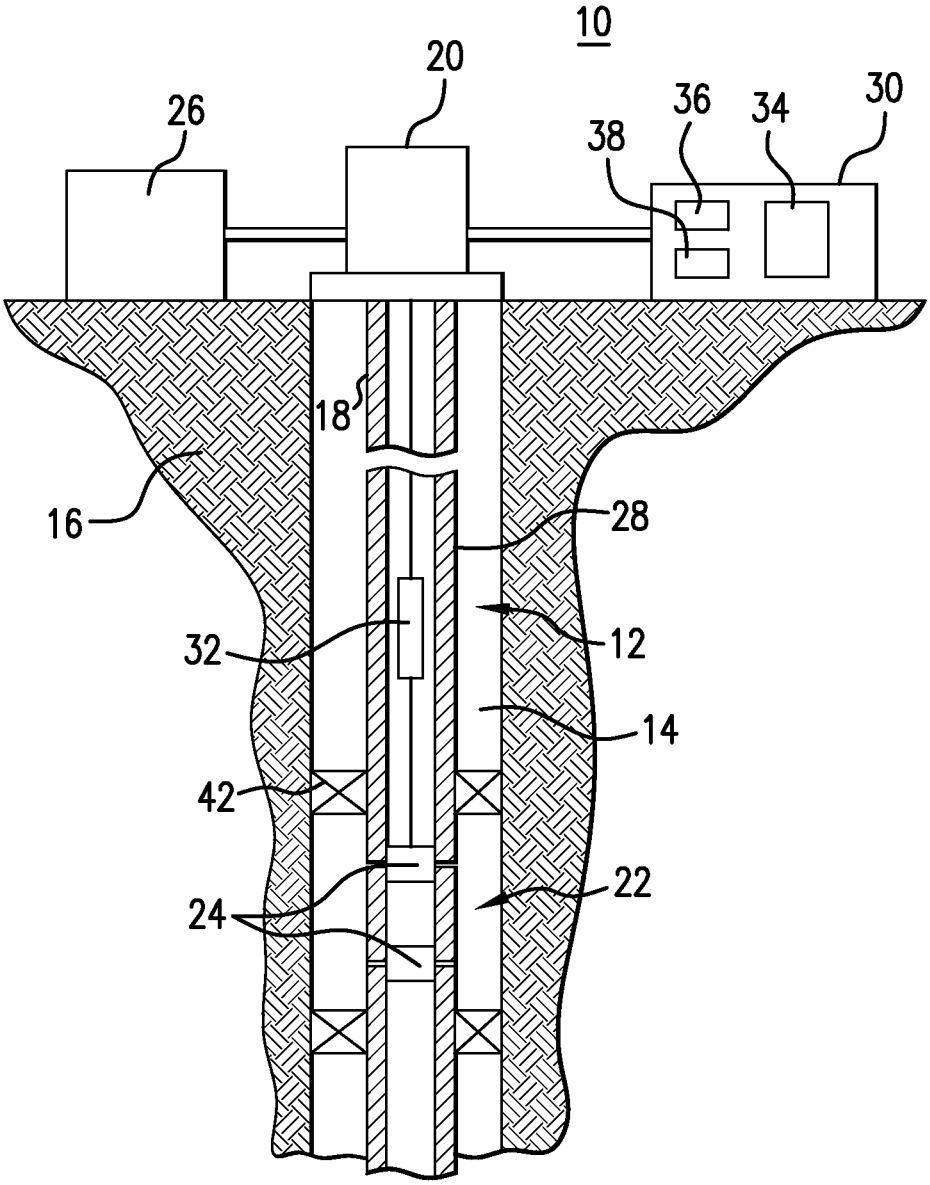
FIG. 1 depicts an embodiment of a well production and/or stimulation system.

Referring to FIG. 1, an exemplary embodiment of a hydrocarbon production stimulation system 10 includes a borehole string 12 configured to be disposed in a borehole 14 that penetrates at least one earth formation 16. The borehole may be an open hole, a cased hole or a partially cased hole. In one embodiment, the borehole string 12 is a production string that includes a tubular 18, such as a pipe (e.g., multiple pipe segments) or coiled tubing, that extends from a wellhead 20 at a surface location (e.g., at a drill site or offshore stimulation vessel). A "borehole string" as described herein may refer to any structure suitable for being lowered into a wellbore or for connecting a drill or downhole tool to the surface, and is not limited to the structure and configuration described herein. For example, the borehole string may be configured as a wireline tool, coiled tubing, a drillstring or a LWD string.

The system 10 includes one or more stimulation assemblies 22 configured to control injection of stimulation fluid and direct stimulation fluid into one or more production zones in the formation. Each stimulation assembly 22 includes one or more injection or flow control devices 24 configured to direct stimulation fluid from a conduit in the tubular 18 to the borehole 14. As used herein, the term "fluid" or "fluids" includes liquids, gases, hydrocarbons, multi-phase fluids, mixtures of two of more fluids, water and fluids injected from the surface, such as water or stimulation fluids. Stimulation fluids may include any suitable fluid used to reduce or eliminate an impediment to fluid production. A fluid source 26 may be coupled to the wellhead 20 and injected into the borehole string 12.

In one embodiment, the stimulation fluid is an acid stimulation fluid. Exemplary acid stimulation fluids include acids such as hydrochloric acid (HCl) or mud acid. Acid stimulation is useful for, e.g., removing the skin on the borehole wall that can form when a wellbore is formed in a limestone formation.

The flow control devices 24 may be any suitable structure or configuration capable of injecting or flowing stimulation fluid from the borehole string 12 and/or tubular 18 to the borehole. Exemplary flow control devices include flow apertures, flow input or jet valves, injection nozzles, sliding sleeves and perforations. In one embodiment, acid stimulation fluid is injected from the surface fluid source 26 through the tubular 18 to a sliding sleeve interface configured to provide fluid communication between the tubular 18 and a borehole annulus. The acid stimulation fluid can be injected into an annulus formed between the tubular 18 and the borehole wall and/or from an end of the tubular, e.g., from a coiled tubing Various sensors or sensing assemblies may be disposed in the system to measure downhole parameters and conditions. For example, pressure and/or temperature sensors may be disposed at the production string at one or more locations (e.g., at or near injection devices 24). Such sensors may be configured as discrete sensors such as pressure/temperature sensors or distributed sensors. An exemplary distributed sensor is a Distributed Temperature Sensor (DTS) assembly 28 that is disposed along a selected length of the borehole string 12. The DTS assembly 28 extends along, e.g. the entire length of the string 12 between the surface and the end of the string (e.g., a toe end), or extends along selected length(s) corresponding to injection devices 24 and/or production zones. The DTS assembly 28 is configured to measure temperature continuously or intermittently along a selected length of the string 12, and includes at least one optical fiber that extends along the string 12, e.g., on an outside surface of the string or the tubular 18. Temperature measurements collected via the DTS assembly 28 can be used in a model to estimate fluid flow parameters in the string 12 and the borehole 14, e.g., to estimate acid distribution in the formation 16 and/or production zones.

In one embodiment, the DTS assembly 28, the injection assemblies 24, and/or other components are in communication with one or more processors, such as a surface processing unit 30 and/or a downhole electronics unit 32. The communication incorporates any of various transmission media and connections, such as wired connections, fiber optic connections and wireless connections. The surface processing unit 30, electronics unit 32 and/or DTS assembly include components as necessary to provide for storing and/or processing data collected from various sensors therein. Exemplary components include, without limitation, at least one processor, storage, memory, input devices, output devices and the like. For example, the surface processing unit includes a processor 34 including a memory 36 and configured to execute software for processing measurements and generating a model as described below.

Figure 2:
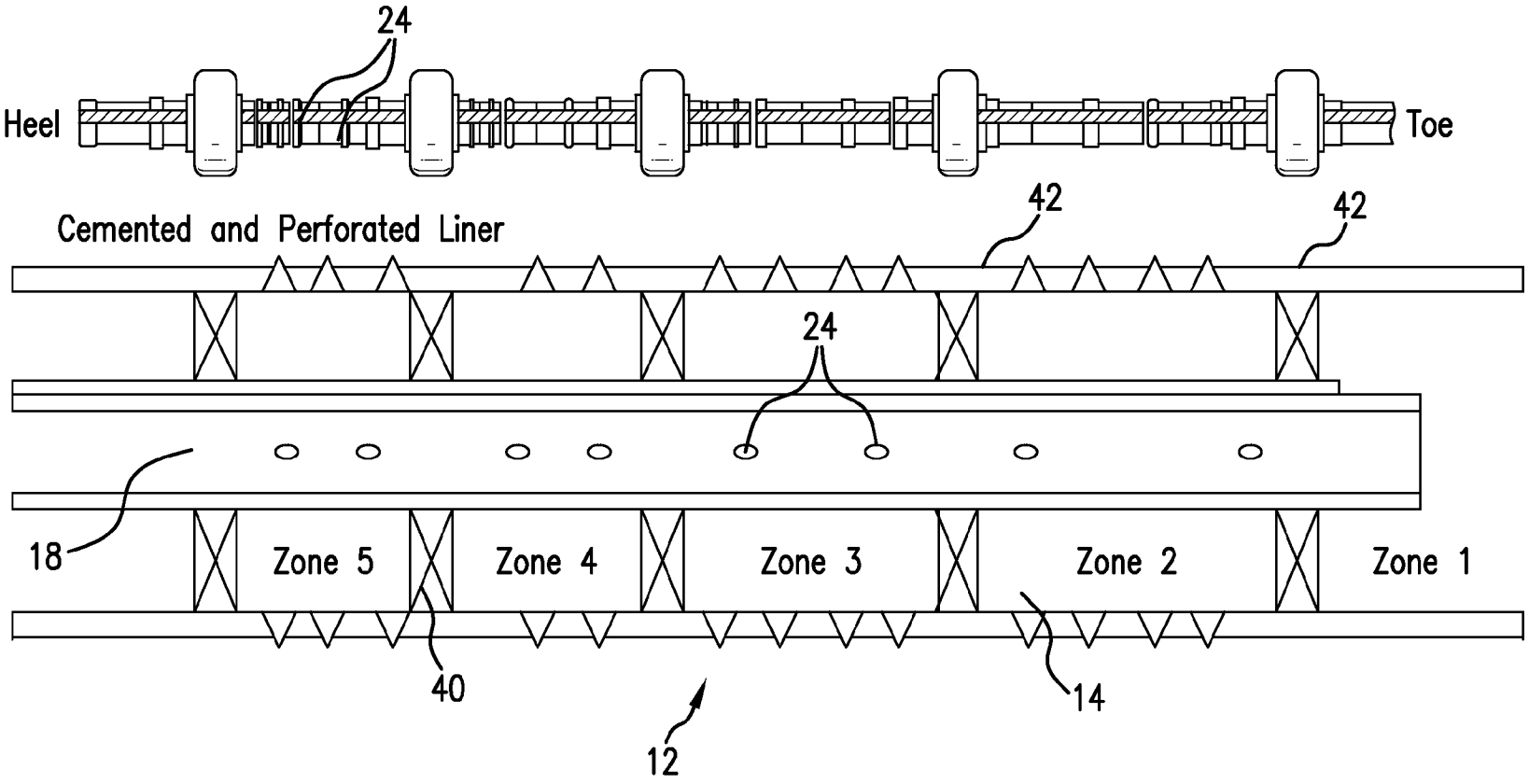
FIG. 2 depicts an embodiment of a stimulation system including multiple zones.

Referring to FIG. 2, the borehole string 12 may define one or more stimulation zones, in which fluid is injected into a selected portion of the borehole 14. For example, as shown in FIG. 2, the tubular 18 includes a cemented and perforated liner 40, and packers 42 disposed at selected locations to define isolated sections of the borehole 14 into which stimulation fluid is injected. These isolated sections are referred to herein as stimulation zones, each of which corresponds to a selected production zone of the formation. In each stimulation zone, at least one injection device 24, such as one or more sliding sleeve devices, provides fluid communication between the tubular 18 and the borehole 14. In the example of FIG. 2, the borehole 14 is separated into four stimulation zones referred to as Zones 2-5. In this example, the string 12 includes at least one pressure/temperature gauge in each zone, although other measurement configurations (e.g., DTS) may be used.

The system 10, in one embodiment, is configured to monitor stimulation processes such as acid stimulation. A mathematical model of fluid flow and energy balance in the borehole string, the borehole (e.g., borehole annulus) and/or the formation may be used to evaluate fluid flow and effectiveness of the stimulation process.

The model is based on steady-state flow and unsteady-state heat transfer, and takes into account several fluid flow and thermal phenomena that can be monitored. One phenomenon is a cool-down effect from the acid entering the formation. Another phenomenon is a temperature rise that occurs shortly after the cooling effect, which occurs as chemical reactions between the acid and the formation (e.g., the carbonate reservoir) release heat as a by-product. The model takes into account one or both phenomena and can simulate the acid distribution by simultaneously solving momentum and energy balance both in the production tubing and annulus, or solely within the borehole (e.g., when fluid is injected ahead of the tubular). The model may be able to handle multiple production zones, each with its own zonal properties and is applicable for gas and oil wells in both onshore and offshore environments.

Figure 3:
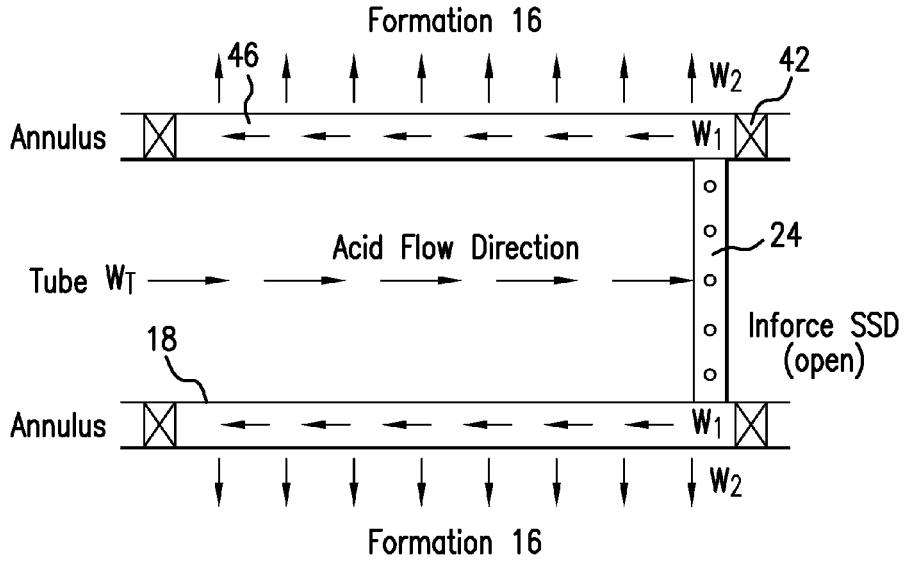
FIG. 3 illustrates exemplary fluid flows in a zone during a stimulation process.
Figure 4:
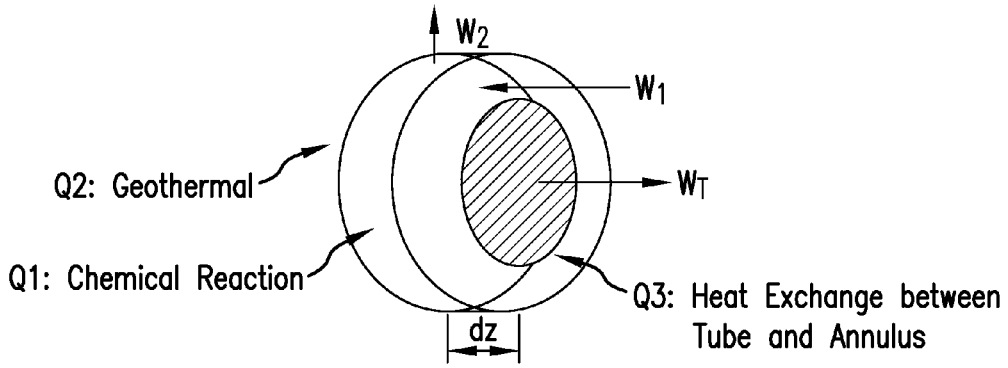
FIG. 4 illustrates fluid flows and heat sources in a borehole.

FIGS. 3 and 4 show aspects of the model, including relationships of parameters in the borehole and formation during a stimulation process that can be calculated using energy balance equations for the tubular and/or the borehole. In one embodiment, the model is a nodal thermal model that can account for both the geothermal and Joule Thomson effects on the injected fluids as they flow from the completion to the reservoir.

The model may be used in conjunction with measurement data taken during stimulation, such as continuous temperature measurements provided by DTS systems. The model allows for interpretation of the temperature data to provide information regarding the stimulation. For example, analysis software can be used to predict the distribution of acid in the formation along a borehole during an acid stimulation, and can evaluate the stimulation by comparing the model prediction to measured temperature values, based on the model, which solves momentum and energy balance equations under the assumptions of steady-state flow and unsteady-state heat transfer FIG. 3 is a diagram of an example of fluid flow of acid during an exemplary stimulation. In this example, acid (included in stimulation fluid) is injected from the surface though a conduit such as the tubular 18. The acid flows through an interface (e.g., injection device 24) such as a sliding sleeve valve interface into an annular region of the borehole, i.e., an annulus 46. In this example, the acid is injected into the annulus at the downhole end of an isolated zone near a packer 42. As shown in this example, the acid flows into the formation 16, but also produces a counterflow along the annulus.

Referring to FIG. 4, the thermal model takes into account heat exchange from one or more heat sources. In one embodiment, the heat sources include a heat source "Q1" from the chemical reaction between the acid and the formation (acid-rock exothermic reaction heat), a formation geothermal heat source "Q2" and heat exchange "Q3" between production tubing and the annulus (e.g., between packers). The model also takes into account fluid flow "$W_T$" in the tubular, fluid flow "$W_2$" into the formation and a counterflow "$W_1$" in the annulus.

In one embodiment, the model calculates temperature based on momentum and energy balance equations. For example, the following energy balance equations are used. For the region in the annulus, the following equation is used:

$$(W_1-W_2)[dHa/dz-g\sin(\theta)/(J_c g_c)+V_a/(Jg_c)*(dV_a/dz)]+W_2Cp(T_{exit}-Ta)/dz=Q1+Q2-Q3,$$

and for the tubing region in the production zone, the following equation is used:

$$W_t[dH_t/dz+g\sin(\theta)/(J_c g_c)+V_t/(Jg_c)*(dV_t/dz)]=Q3.$$

In the above equations, $W_T$ is the fluid mass rate of acid (e.g., lbm/hr) in the injection fluid through a tubular, corresponding to an injection flow rate and a concentration of acid in the injection fluid. $W_1$ is the fluid mass rate of acid flowing axially in the annulus, corresponding to a concentration of acid in fluid in the annulus. $W_2$ is the fluid mass rate of acid flowing into the formation, corresponding to a concentration of acid in the formation. Q1, Q2 and Q3 are heat flow rates per unit length, e.g., in Btu/hr.ft, "Ha" is the fluid enthalpy in the annulus, "z" is the variable well depth from the surface, "g" is the gravitational acceleration, "θ" is the wellbore inclination angle, "$J_c$" and "$g_c$" are conversion factors, "$V_a$" is acid and/or fluid velocity in the annulus, and Cp is the heat capacity. "$T_{exit}$" is the temperature of the acid in the annulus passing to the formation, and "Ta" is the temperature of the acid in the annulus. "Ht" is the fluid enthalpy in the tubular, and "$V_t$" is fluid velocity in the tubular.

Calculation of Q1 is performed based on information including the chemical constituents of the stimulation fluid and the major reservoir components. Based on this information, the chemical reactions are calculated.

An exemplary calculation of Q1 is described with reference to an example in which a stimulation operation is to be performed using a hydrochloric acid (HCl) based stimulation fluid. In this example, the chemical reaction heat Q1 is based on the following reaction with calcium carbonate ($CaCO_3$) in the formation:

$$CaCO_3+2HCL\ldots\rightarrow CaCl_2+H_2O+CO_2+Q1.$$

The following standard enthalpy values may be used in the calculation:

$CaCO_3$=1207.6 KJ/mol,

HCl=167.2 KJ/mol, $CaCl_2$=877.3 KJ/mol, $H_2O$=285.83 KJ/mol, and $CO_2$=393.509 KJ/mol.

For every two mol HCl, heat generated from the reaction can be calculated as:

$$Q=877.3+393.509+285.83-1207.6-2*167.2=14.639\ \text{KJ/mol}=13.876\ \text{Btu/mol}.$$

For mass rate $W_2$ (acid flow into the targeted formation) with concentration 15% HCl, the number of HCl mol is:

$$W_2*15\%/(36.46*2.2/1000)=1.87*W_2\ (\text{mol HCl/hr})$$

Thus, the total Chemical Reaction Heat Q1 per foot in this example is estimated as:

$$Q1=1.87*W_2*13.876/2=12.974*W_2\ (\text{Btu/hr.ft})$$

In one embodiment, the reaction heat Q1 is calculated using an overall reaction factor "f". The reaction factor f addresses the difficulty in calculating Q1, which is dependent on a variety of potentially unknown or insufficiently known factors, such as the percentage of reaction heat that is measured by DTS and the variety of temperature and pressure changes that occur during the acid stimulation. For example, the above enthalpy values are stated at standard conditions, not at downhole treatment conditions, and as such using these values for calculation can introduce significant errors without correction. Furthermore, DTS only measures part of the total reaction heat and the percentage of the total heat that DTS measures is also unknown. Attempts were made to lab-verify the heat released through the chemical reaction by using reservoir core plugs. However, the difficulty in replicating the downhole conditions during the actual acid stimulation due to the large range of pressure and temperature changes rendered this verification attempt unsuccessful. The overall reaction factor f described herein provides an ability to model and calculate Q1 without requiring perfect knowledge of each contributing individual component.

Using this reaction factor, the final chemical reaction heat in the above example can be expressed as:

$$Q1=f*12.974*W_2(\text{Btu/hr.ft}).$$

The overall reaction factor f, in one embodiment, is assumed to be constant in each zone, but can vary from zone to zone. In addition, the overall reaction factor can be a single value for a zone or a plurality of different values within a zone. The reaction factor f can also be a correlation related to reservoir properties such as permeability if the reservoir property data is available.

As further discussed below, for any given acid treatment, the overall reaction factor (assuming constant in each zone, but can vary from zone to zone) can be calculated using an iterative process by comparing a reaction temperature model to DTS measurements. An embodiment of such a process includes the following steps:

1. Assume an acid distribution, e.g., assume the acid is evenly distributed in one or more zones;
2. define (e.g., by a user) and input a starting overall chemical reaction factor value (for example, 0.1 and each incremental change is 0.01);
3. using suitable analysis software in the forward mode, generate a temperature curve (also referred to as a type curve) based on the starting reaction factor;

4. calculate the total energy change under the generated temperature curve, and calculate a total energy change under a DTS trace acquired during an acid stimulation process; and
5. compare the two total energy changes. If the difference of the two energy changes is within an acceptable tolerance, the iteration process is stopped and the starting value is used. If the difference is not within the tolerance, select a new reaction factor by adding an incremental change. For each incremental change, a new type curve is generated and compared to the DTS trace as discussed in steps 3 and 4, and a difference is calculated. This is repeated until an acceptable reaction factor f is found.

Formation geothermal heat Q2 may be calculated based on the temperature difference between the formation and annulus, formation thermal properties and total injection time. The formation temperature can be calculated based on geothermal gradient. For the example described herein, based on known characteristics of the formation, the geothermal gradient can be calculated as 0.016 deg F/ft.

For calculation of Q3, well completion details (such as tubing/casing diameters) are used. For example, heat exchange Q3 between the tubular and annulus is calculated using inputs including sizes of the tubular and any casing.

In one embodiment, correlation for the heat exchange Q3 can be calculated using the following equation:

$$Q3=2\pi r_t U_t(T_t-T_a)$$

where "$r_t$" is the tubular radius, "$U_t$" is the overall heat transfer coefficient between the tubular and the annulus, "$T_t$" is the tubular temperature and "$T_a$." is the annulus temperature.

In the example described herein, Q3 is calculated based on the tubular including 3½" tubing with an inside diameter (ID) equal to 2.992" and a 7" liner with an ID equal to 6.184". The stimulation zone, or length portion along which the model is calculated may also be provided as an input. In this example, the model zone is defined by two points: a point A with measured depth (MD) equal to 11,400 ft, and a point B with MD equal to 15,326 ft.

If the borehole section for which the model is calculated includes an inclined and/or horizontal section, the inclination may be calculated. In this example, the borehole includes a horizontal section with a calculated inclination angle of 89.21 degrees.

Additional characteristics of the completion are also used in the calculation. In the example described herein, the following property values are used in the model simulation:
Tubing Wall Conductivity: 26 Btu/ft.hr.° F.,
Casing Wall Conductivity: 26 Btu/ft.hr.° F.,
Formation Rock Conductivity: 3.33 Btu/ft.hr.° F.,
Heat Capacity of Rock: 0.625 Btu/lb.° F.,
Heat Capacity of Acid: 1.0 Btu/lb.° F.

It is noted that the model need not necessarily include all of heat sources Q1, Q2 and Q3. For example, in some acid stimulation processes, a coiled tubing is advanced downhole and acid stimulation fluid is injected into an open hole. In such processes, a section of the borehole may not include a heat exchange between a tubular and annulus, and thus there may not be a counterflow within that section. Accordingly, the model and the energy balance equations only include heat sources Q1 and Q2. In addition, if there is no counterflow, $W_1$ is not included in the model and calculation.

In the embodiments described herein, the model is calculated, and predictions performed for each stimulation zone in the borehole corresponding to a production zone. However, the embodiments are not so limited, as the model may be calculated over multiple production zones, or multiple models may be calculated for a single production zone. For example, multiple flow models may be calculated for a single production zone if the sliding sleeve valve or other injection device is located between the packers, instead of at or near the packers. This configuration may result in two different flow models: one model taking into account heat exchange between the tubular and annulus (Q3) and counterflow if present, and a second model for the area in which the tubular has not extended that takes into account only heat sources Q1 and Q2, and may not include a counterflow.

A forward simulation method is provided that involves applying the model to predict a temperature and/or acid distribution for a known injection profile. In this method, a known or desired stimulation profile that includes a selected acid distribution is entered into the model, such as by entering selected information including acid velocity and heat sources Q1, Q2 and/or Q3 into the above equation(s) to calculate a predicted profile. For example, a predicted temperature profile based on desired acid distribution is generated via the model. The predicted profile is provided as output to a user and/or processor for analysis. In one embodiment, the method is used in comparison with measured temperatures to calibrate the model.

One or more zones may be selected for prediction and/or analysis based on the model. For example, the borehole string shown in FIG. 2 includes four stimulation zones shown as Zones 2-5. A user may select one or more of the zones. In addition, the model can be calculated for specific sections within each zone. The model and analysis can be integrated with other information such as logging information (e.g., permeability distribution). In one embodiment, in each specific section of the zone, the model assumes that the formation is homogeneous. In another embodiment, the model is altered to reflect the heterogeneity of the formation based on previous logging data.

For each selected section, the model may be calculated for each of one or more times associated with a stimulation process (i.e., stimulation times). In one embodiment, the stimulation time is selected to account for temperature effects including the cooling effect and chemical reaction thermal effect described above. Exemplary stimulation times include times at or after which the acid fluid is expected to penetrate the formation and/or during which the cooling effect dissipates and/or ends and chemical reaction heat is expected to be produced. For example, the injection time for which the model is calculated is selected based on the cooling effect, e.g., the injection time is selected at a time after the cooling effect ends and the chemical reaction heating starts (or at a time at or near the end of the chemical reaction heating).

Figure 5:
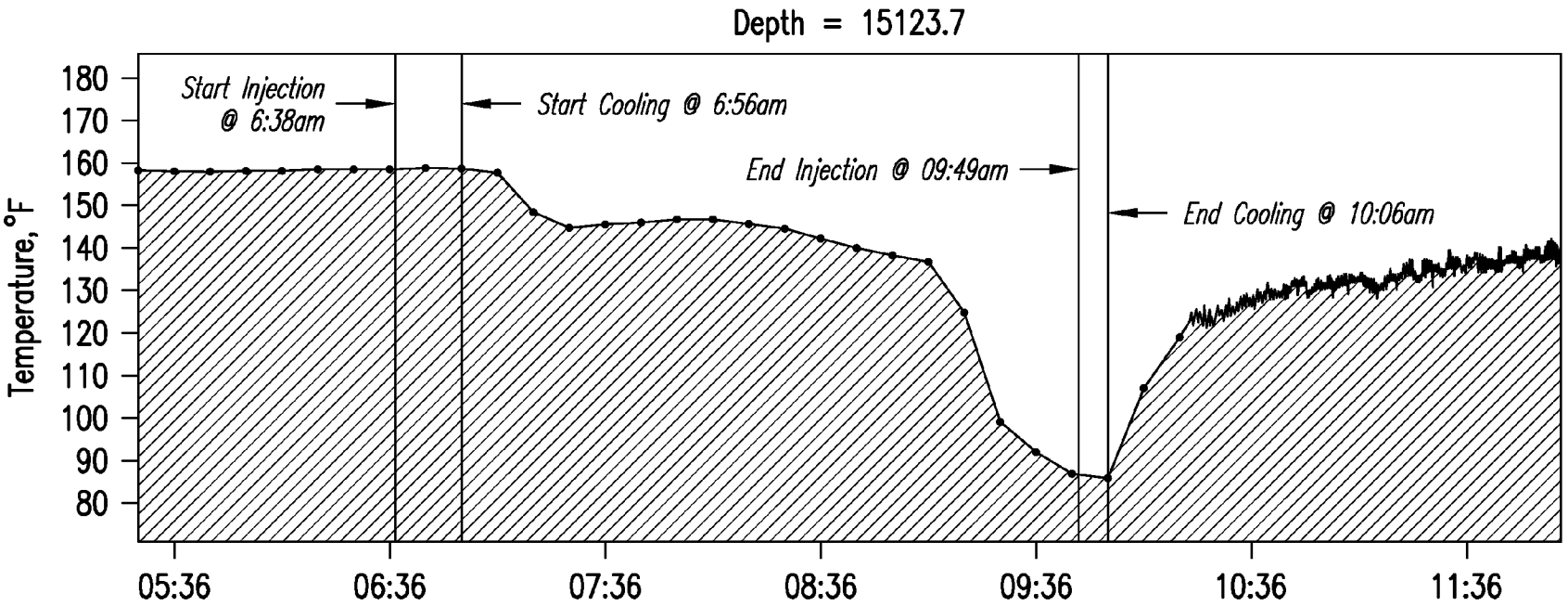
FIG. 5 shows exemplary temperature data taken at a selected depth during a stimulation operation.

FIG. 5 shows exemplary stimulation times for which the model may be calculated. In this example, temperature changes at a fixed depth of 15,123.7 ft were measured during an acid stimulation. In this example, injection started at 06:38 am and stopped at the surface at 09:49 am. The zone at this depth did not show the cooling effect until about 18 minutes later (at 06:56 am). As shown in the temperature data, the cooling effect lasted until about 10:06 am. A stimulation time that can be used for the model is 10:16 am. Thus, the model is calculated based on expected acid distributions at this time. Measured data (e.g., a DTS trace) at this time is used for comparison/analysis.

Figure 6:
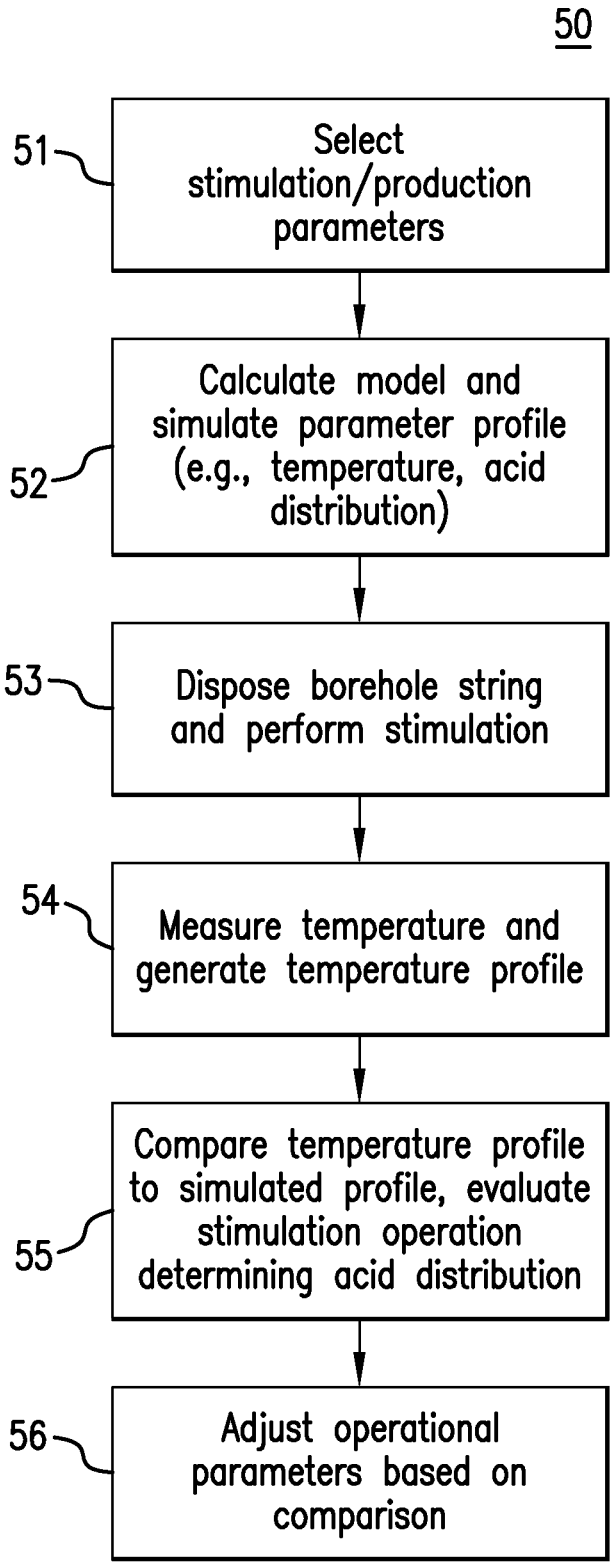
FIG. 6 is a flow chart providing an exemplary method of simulating a stimulation operation, performing a stimulation, and/or evaluating the stimulation based on a model.

FIG. 6 illustrates a method 50 of monitoring and/or analyzing an acid stimulation process. The method 50 may include any combination of stimulation, prediction, monitoring, analysis and control of the stimulation. The method 50 is described in conjunction with the stimulation system described in FIGS. 1 and 2 in conjunction with the DTS assembly 28 and/or the surface processing unit 30, although the method 50 may be utilized in conjunction with any suitable combination of temperature sensing devices and processors. The method 50 includes one or more stages 51-56. In one embodiment, the method 50 includes the execution of all of stages 51-56 in the order described. However, certain stages may be omitted, stages may be added, or the order of the stages changed.

In the first stage 51, a plurality of production and/or stimulation parameters (a stimulation profile) are selected. For example, various structural aspects such as tubular type and dimensions are selected. In addition, the chemical composition of stimulation or production fluid is selected, including, for example, the type and concentration of acid in stimulation fluid, as well as a desired acid distribution. Other exemplary parameters include assumed flow rates, depths, stimulation zones and formation parameters such as content and permeability.

In the second stage 52, the model is calculated, e.g., based on the equations and considerations described above. For example, a processor such as the surface processing unit 30 runs software 38 in a forward simulation mode and calculates a temperature distribution for a selected stimulation time along the borehole 12 for the given stimulation profile. The model may also be calibrated based on measured data. For example, the model is run using iterative procedures to calculate the temperature and minimize the value of C1, which is the sum of squared temperature errors between measured data and simulated data.

For calculation of the reaction heat Q1, an initial temperature curve is generated based on assumed conditions. For example, it is assumed that the acid is evenly distributed. Based on this assumption, an initial reaction factor is used to generate a type curve or temperature curve, which is a model of the reaction heat distribution along a stimulation zone.

The model calculations and predictions may be used to evaluate and/or control a stimulation operation, as described further below. In addition, the model may be used to emulate various "what-if" scenarios, and can provide a user with an estimate of the temperature changes to be generated, and thus a specification for the temperature sensing devices and/or techniques required to realize the benefits of the model.

In the third stage 53, a borehole string is disposed within the borehole 12 and a production and/or stimulation process is performed. For example, an acid stimulation process is performed for one or more zones, such as Zones 2-5 shown in FIG. 2. In one embodiment, the acid stimulation is performed using stimulation parameters defined in the simulation.

In the fourth stage 54, temperature data is taken from borehole fluid using, e.g., the DTS assembly 28. The temperature data may be a plurality of signals induced at various locations along the borehole that form a temperature profile, e.g., a DTS trace. In one embodiment, the temperature data is taken from measurements performed along the borehole (e.g., one or more measurements for corresponding locations within each zone) while the string is fixed in the borehole or as the string is advanced or retracted through the borehole.

A processor such as the surface processing unit 30 calculates a temperature profile. As described herein, a profile includes one or more measurements or values (e.g., temperature, fluid flow, acid concentration), each associated with a specific location along the optical fiber. A sufficient number of measurements are taken, for example, to generate a continuous temperature and/or fluid flow profile.

In the fifth stage 55, the predicted temperature profile (or selected parts thereof) is compared to the measured temperature for selected portions or zones. The comparison may be repeated for any number of selected regions or zones within the borehole. In addition, the comparison may be repeated for multiple sections within a selected stimulation zone.

In one embodiment, the measured temperature profile is compared to the predicted temperature curve by calculating a measured total energy change (the total energy change calculated for the measured profile) and a predicted total energy change (the total energy change calculated for the predicted profile). If the difference is within a selected tolerance, the initial reaction factor is selected and used to calculate Q1. If the difference is not within the tolerance, the reaction factor is incrementally changed until the difference is within the tolerance.

In one embodiment, the measured temperature data or profile is used with the model to generate a parameter profile. An exemplary parameter profile is an acid concentration or acid distribution profile. In one embodiment, the comparison is used to generate a type curve based on the specific well completion, geothermal and operational parameters of the stimulation. On or more of these profiles can be transmitted and/or displayed to a user to allow the user to evaluate the effectiveness of the stimulation. The profiles can be generated in real-time during the stimulation process to allow the user to evaluate the stimulation and make adjustments in real time. The profiles, e.g., the simulation profile, the parameter profile and/or the type curve may be used to visualize or otherwise determine what sections have been under- or over-stimulated.

In the sixth step 56, the results of the simulation and/or comparison are transmitted to a user or processor, and the simulation is evaluated. For example, based on the acid distribution curve(s) and/or type curve, a user can visualize which sections are under- or over-acidizing. Based on the evaluation, the stimulation or other procedure can be adjusted or refined.

FIGS. 7-10 illustrate an example of the method 50 as applied to an exemplary acid stimulation process. The simulation and stimulation described in this example use a model calculated according to the equations discussed above. Measurement and simulation were conducted for Zones 2-5 as shown in FIG. 2. Simulation and measurement data are discussed below for Zones 2 and 5.

The method 50 was performed in this example using software including a flow profiling mode that estimates injection flow rates as a function of the measured depth of the well bore based on the comparison of the measured temperatures with the pre-defined well bore model.

As shown in this example, an embodiment of the method 50 includes generating a simulation plot of temperature values over selected zones. The method 50 may also include generating a stimulation or production parameter chart or plot such as a fluid flow rate profile or an acid distribution chart.

Figure 7:
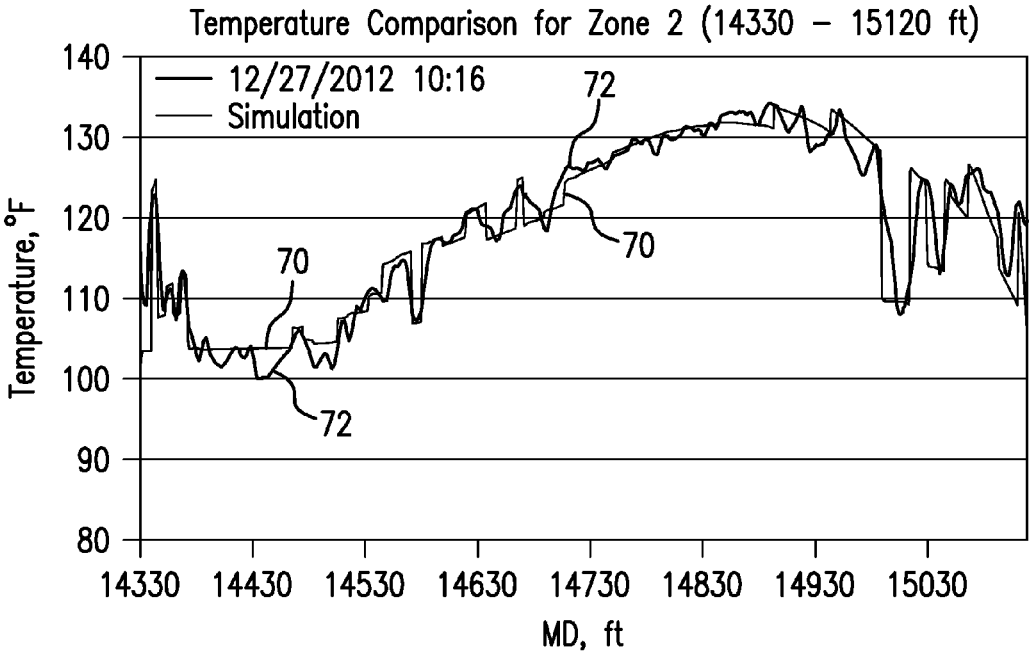
FIG. 7 depicts exemplary temperature profiles associated with a stimulation based on measured data and simulated data, calculated based on the method of FIG. 6.

FIG. 7 depicts a simulation profile 70 for Zone 2 showing simulated temperatures calculated via the model based on the selected formation, borehole string and stimulation parameters. The simulation profile 70 may be compared to a measured temperature profile 72 generated during the stimulation.

The following operation parameters are used for this zone (Zone 2):

The total injection time was 218 minutes,
Average injection rate was 7.97 BPM, and
Average HCL concentration was 9.1%

FIG. 7 shows a comparison between the simulation profile and the measured temperature profile (measured using DTS measurements). As is evident, the two profiles match fairly well. However, acid distribution data calculated based on the model and the measured temperature profile 72 demonstrates that sections of this zone were under-acidized, i.e., did not receive as much acid as desired.

Figure 8:
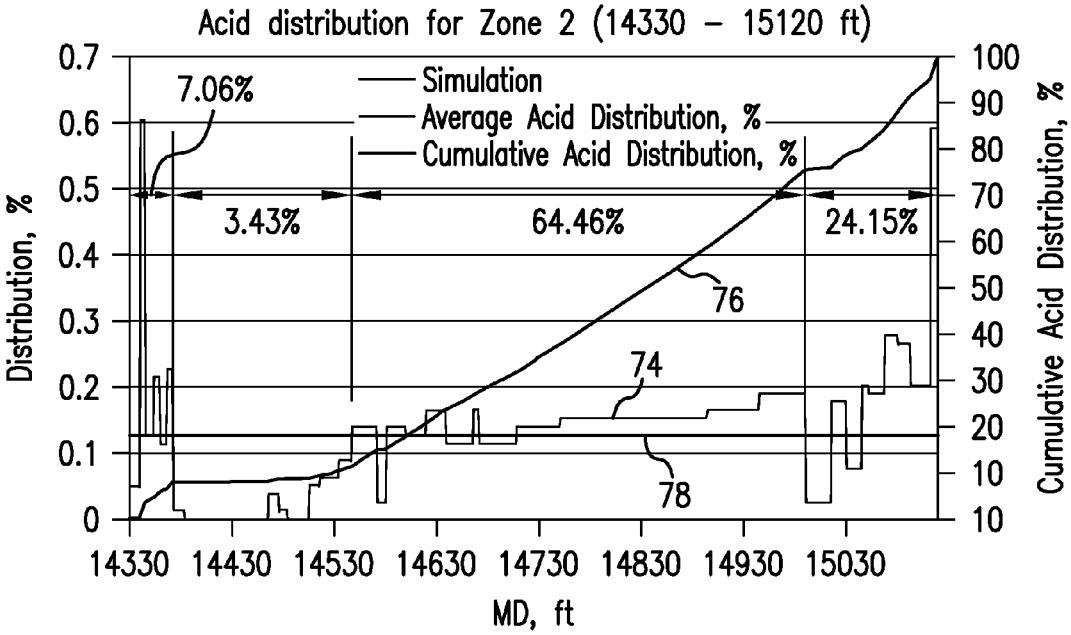
FIG. 8 depicts exemplary acid distribution profiles associated with the stimulation of FIG. 7.

FIG. 8 includes acid distribution data calculated based on the model and the measured temperature, which shows the acid distribution along Zone 2. A simulation distribution profile 74 is calculated based on the model and measured temperature data. A cumulative profile 76 represents cumulative acid distribution and an average distribution profile 78 represents the average acid distribution. As is shown in FIGS. 7 and 8, although the highest temperature occurs around a depth of about 14,910 ft, that does not mean that this depth took the greatest acid volume. The temperature is affected not just by acid concentration, but due to the flow direction and the combined effect of the three heat resources accounted for in the model, i.e. the chemical reaction heat (Q1), formation geothermal heat (Q2) and heat exchange between tube and annulus (Q3).

The profile in FIG. 8 demonstrates that acid in this zone is not evenly distributed. Almost 90% of acid went to the first approximately 575 ft (i.e., from about 14546 to 15120 ft), while the remaining approximately 225 ft only received about 10% of acid. Particularly in the section from about 14373 to 14546 ft, the acid concentration was way below the average acid distribution line, taking only about 3.4% of the acid.

Another observation from this example shows that acid distributions may not be evenly distributed within a zone. For example, in Zone 2 of this example, due to the injection location and counter flow, the short section close to the zone end towards the toe takes more acid per foot than other sections of the zone.

Figure 9:
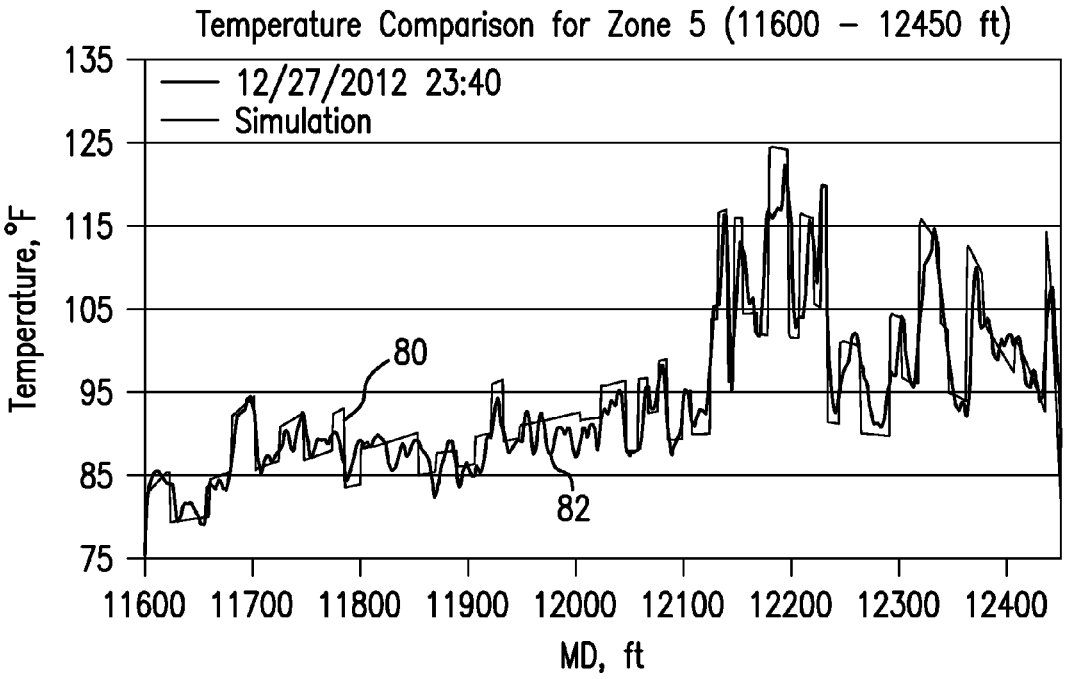
FIG. 9 depicts exemplary temperature profiles associated with a stimulation based on measured data and simulated data, calculated based on the method of FIG. 6.
Figure 10:
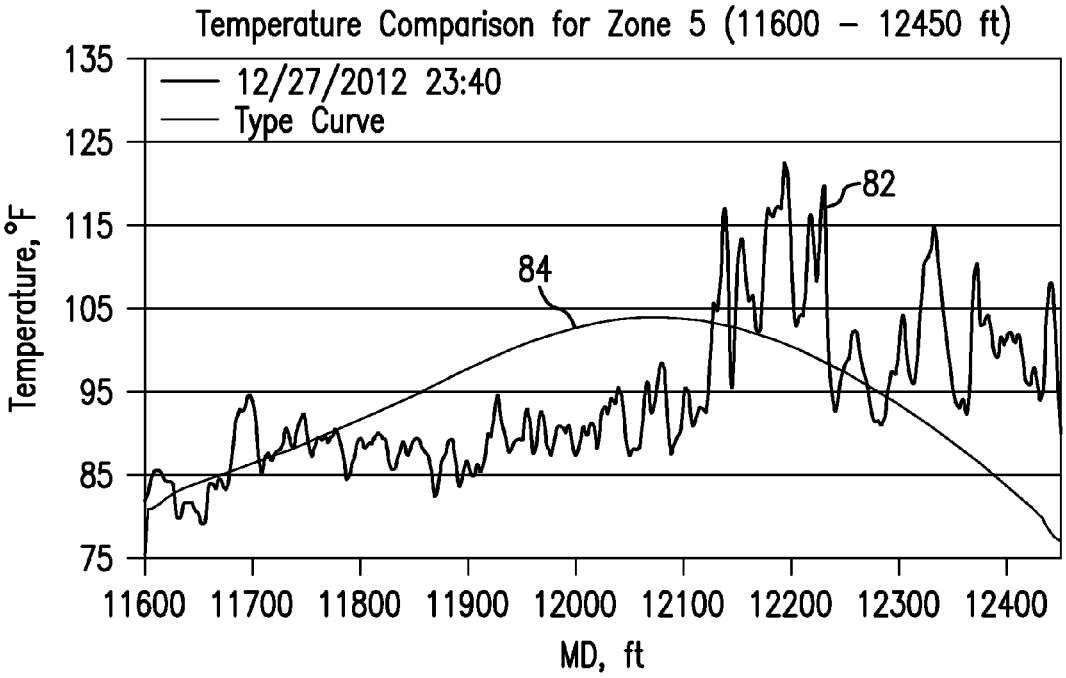
FIG. 10 depicts an exemplary type curve associated with the stimulation of FIG. 9.

FIGS. 9 and 10 show comparisons between a simulation profile 80 and a measured temperature profile 82 for Zone 5. For this zone, the following operational parameters were used:

The total injection time was 182 minutes,
Average injection rate was 9.63 BPM, and
Average HCL concentration was 8.98%, FIG. 9 shows the comparison between the simulated temperature and DTS traces. The measured temperature profile 82 represents the DTS measurements and the simulation profile 80 represents the temperatures calculated based on the model. Again, good agreement is achieved between simulated temperature and DTS measurement. FIG. 10 shows an exemplary type curve 84 for temperature as compared to the measured temperature profile. The type curve 84 in this example is generated based on evenly distributed acid and operational conditions. Temperatures above this type curve 84 signal over-acidizing, while temperatures below this type curve represent under-acidizing section(s). This type curve allows users to visualize and qualitatively identify approximate acid distribution immediately after the end of acid stimulation by overlaying the type curve with the actual DTS measurements. In the zone shown in this example, the section at the end towards the toe signals over-acidizing, while the other end towards the heel suggests a relatively flat distribution. However, in the middle of the section (including from about 12133 to 12436 ft), temperature is below the type curve, signaling under-acidizing. Further calculation confirms that this section took about 21% of the total acid which is below the average acid distribution.

Generally, some of the teachings herein are reduced to an algorithm that is stored on machine-readable media. The algorithm is implemented by a computer or processor such as the surface processing unit 30 and provides operators with desired output. For example, data may be transmitted in real time from a downhole sensor to the surface processing unit 30 for processing.

The systems and methods described herein provide various advantages over prior art techniques. The systems and methods described herein are useful in well monitoring, and particularly for effectively estimating acid distribution in production zones. The models described herein provide an accurate estimation of acid distribution and/or concentration by taking into account at least heat generated by chemical reactions with acid in the stimulation fluid, providing a superior indication of acid distribution. In addition, the embodiments described herein provide a way to obtain acid distribution both qualitatively and quantitatively, and provide a visualization or other indication that allows for rapid identification of over-acidized and/or under-acidized sections. Furthermore, the model described herein is advantageous in that it can be applied to segments of a wellbore that contain multiple production zones.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

The invention claimed is:

1. A method of evaluating a stimulation operation, comprising:

receiving parameter information for the stimulation operation, the stimulation operation including injecting an acid stimulation fluid into an earth formation along a selected length of a borehole from a tubular disposed in the borehole; and generating, by a processor, a thermal model based on one or more energy balance equations that account for at least a first heat source and a second heat source, the first heat source expected to produce reaction heat during the stimulation by a chemical reaction between an acid in the stimulation fluid and the formation, and the second heat source including expected geothermal heat from the formation, the thermal model configured to predict an amount of the reaction heat per unit length of the borehole.

2. The method of claim 1, further comprising receiving a plurality of temperature measurements taken along the selected length by a sensor assembly disposed in the borehole.

3. The method of claim 2, further comprising calculating a predicted temperature profile along the selected length based on the model.

4. The method of claim 3, further comprising comparing the predicted temperature profile to a measured temperature profile generated based on the plurality of temperature measurements.

5. The method of claim 2, further comprising generating acid distribution data based on the model and the temperature measurements, the acid distribution data representing a distribution of an amount of acid injected in the formation along the selected length of the borehole.

6. The method of claim 5, further comprising generating an acid distribution profile from the acid distribution data, and comparing the acid distribution profile to a predicted acid distribution to identify at least one of an over-acidized region and an under-acidized region.

7. The method of claim 1, wherein the thermal model is configured to predict the amount of the reaction heat per unit length of the borehole based on an expected distribution of acid along a stimulation zone.

8. The method of claim 7, wherein the one or more energy balance equations account for expected heat exchange between the tubular and the annulus during the stimulation operation.

9. The method of claim 8, wherein the one or more energy balance equations include the following equation for a region in the annulus:

$$(W_1-W_2)[dHa/dz-g\sin(\theta)/(J_cg_c)+V_a/(Jg_c)*(dV_a/dz)]+W_2Cp(T_{exit}-Ta)/dz=Q1+Q2-Q3,$$

wherein $W_1$ is the fluid mass rate of acid flowing axially in the annulus, $W_2$ is the fluid mass rate of acid flowing into the formation, Q1 is a heat flow rate from the first heat source, Q2 is a heat flow rate from the second heat source and Q3 is a heat flow rate from the heat exchange, Ha is the fluid enthalpy in the annulus, z is a variable well depth, g is the gravitational acceleration, θ is an inclination angle, $J_c$ and $g_c$ are conversion factors, "$V_a$" is acid velocity in the annulus, Cp is a heat capacity, $T_{exit}$ is a temperature of the acid in the annulus passing to the formation, and Ta is a temperature of fluid in the annulus.

10. The method of claim 9, wherein the one or more energy balance equations include the following equation for a region in the tubular:

$$W_t[dH_t/dz+g\sin(\theta)/(J_cg_c)+V_t/(Jg_c)*(dV_t/dz)]=Q3$$

wherein $W_T$ is a fluid mass rate of acid, Ht is the fluid enthalpy in the tubular, and $V_t$ is fluid velocity in the tubular.

11. An earth formation stimulation system comprising:

a stimulation assembly configured to be disposed in a borehole and perform a stimulation operation, the stimulation assembly including a tubular and at least one injection device configured to inject an acid stimulation fluid into an earth formation;

a sensor assembly configured to take a plurality of temperature measurements along a selected length of the borehole; and a processor in operable communication with the sensor assembly, the processor configured to receive the plurality of temperature measurements and apply a thermal model to the plurality of temperature measurements, the model based on one or more energy balance equations that account for at least a first heat source and a second heat source, the first heat source expected to produce reaction heat during the stimulation operation by a chemical reaction between an acid in the stimulation fluid and the formation, and the second heat source including expected geothermal heat from the formation, the thermal model configured to predict an amount of the reaction heat per unit length of We borehole.

12. The system of claim 11, wherein the injection device is configured to provide flow of the stimulation fluid between the tubular and an annulus formed between the tubular and a borehole wall.

13. The system of claim 12, wherein the one or more energy balance equations account for expected heat exchange between the tubular and the annulus during the stimulation operation.

14. The system of claim 13, wherein the model accounts for acid flowing through the tubular, acid flowing into the formation and acid in a fluid counterflow in the annulus.

15. The system of claim 14, wherein the one or more energy balance equations includes the following equation for a region in the annulus:

$$(W_1-W_2)[dHa/dz-g\sin(\theta)/(J_cg_c)+V_a/(Jg_c)*(dV_a/dz)]+W_2Cp(T_{exit}-Ta)/dz=Q1+Q2-Q3,$$

wherein $W_1$ is the fluid mass rate of acid flowing axially in the annulus, $W_2$ is the fluid mass rate of acid flowing into the formation, Q1 is a heat flow rate from the first heat source, Q2 is a heat flow rate from the second heat source and Q3 is a heat flow rate from the heat exchange, Ha is the fluid enthalpy in the annulus, z is a variable well depth, g is the gravitational acceleration, θ is an inclination angle, $J_c$ and $g_c$ are conversion factors, "$V_a$" is acid velocity in the annulus, Cp is a heat capacity, $T_{exit}$ is a temperature of the acid in the annulus passing to the formation, and Ta is a temperature of fluid in the annulus.

16. The system of claim 15, wherein the one or more energy balance equations includes the following equation for a region in the tubular:

$$W_t[dH_t/dz+g\sin(\theta)/(J_c g_c)+V_t/(Jg_c)*(dV_t/dz)]=Q3$$

wherein $W_T$ is a fluid mass rate of acid, Ht is the fluid enthalpy in the tubular, and $V_t$ is fluid velocity in the tubular.

17. The system of claim 11, wherein the processor is configured to calculate a predicted temperature profile along the selected length based on the model.

18. The system of claim 17, wherein the processor is configured to compare the predicted temperature profile to a measured temperature profile generated based on the temperature measurements.

19. The system of claim 11, wherein the model accounts for the first heat source by predicting reaction heat per unit length of the borehole based on an overall reaction factor.

20. The system of claim 19, wherein the overall reaction factor is calculated by an iterative process including:

selecting a reaction factor value and calculating a predicted temperature curve based on the reaction factor value and an assumed acid distribution for the stimulation operation;

comparing the predicted temperature curve to a measured temperature profile based on the plurality of temperature measurements, wherein comparing includes calculating a difference between a first total energy change calculated based on the predicted temperature curve and a second total energy change based on the measured temperature profile; and selecting the reaction factor value as the overall reaction factor based on the difference being within a selected tolerance.

21. The system of claim 19, wherein the processor is configured to immediately generate a type curve based on the calculated reaction factor, the type curve allowing an operator to qualitatively identify over- or under-acidizing sections in real time by overlaying the type curve over actual DTS measurements.

* * * * *